United States Patent [19]

Junkeris

[11] Patent Number: 4,960,065

[45] Date of Patent: Oct. 2, 1990

[54] WATER SKI TOW ROPE APPARATUS

[76] Inventor: Edmund Junkeris, 917 Powder Horn Rd., Sun Prairie, Wis. 53590

[21] Appl. No.: 273,211

[22] Filed: Nov. 18, 1988

[51] Int. Cl.[5] ..... B63B 21/16

[52] U.S. Cl. ..... 114/254; 242/86.5 A

[58] Field of Search ..... 114/253, 254, 179; 242/86.5 A

[56] References Cited

U.S. PATENT DOCUMENTS

| | | | |
|---|---|---|---|
| 197,041 | 11/1877 | Manton | 114/179 |
| 1,287,168 | 12/1918 | Young | 114/179 |
| 2,821,726 | 2/1958 | Correll | 114/254 |
| 3,041,996 | 7/1962 | Roberts | 114/254 |
| 3,071,099 | 1/1963 | Cutlan | 114/254 |
| 3,079,885 | 3/1963 | Cooke | 114/253 |
| 3,122,609 | 2/1964 | Moore | 114/253 |
| 3,326,175 | 6/1967 | Baker | 114/254 |
| 3,420,466 | 1/1969 | Sanders | 114/254 |
| 3,443,772 | 5/1969 | Prosser | 242/86.5 A |
| 3,890,918 | 6/1975 | Sell | 114/253 |
| 3,919,963 | 11/1975 | Cox | 114/253 |
| 4,133,496 | 1/1979 | Zetah | 114/254 |
| 4,561,375 | 12/1985 | Paxton | 114/253 |

FOREIGN PATENT DOCUMENTS

| | | | |
|---|---|---|---|
| 187452 | 1/1964 | Sweden | 114/254 |

*Primary Examiner*—Sherman Basinger

*Attorney, Agent, or Firm*—Foley & Lardner

[57] ABSTRACT

A tow apparatus for holding and deploying tow ropes from a boat which employs an axial deploying system, allows the two ropes to be in proper attitude for pulling the skier, clearing any obstructing structures, and provides means for allowing rapid rewind and convenient storage of the tow rope. In one aspect of the invention, an abaxial rope-deploying system may be used in conjunction with the axial system.

7 Claims, 2 Drawing Sheets

WATER SKI TOW ROPE APPARATUS

FIELD OF INVENTION

This invention relates to an apparatus for holding and deploying tow ropes from a boat. In particular, this invention relates to an apparatus for holding and deploying water ski tow ropes from a power boat for towing water skiers.

BACKGROUND OF INVENTION

In recent years, water skiing has become a particularly popular sport. The skiing operation generally begins with the boat being maneuvered to a position relatively close to the skier so that the skier can grasp one end of a tow rope. The other end of the tow rope is attached in some manner to the boat. The boat then is moved slowly away from the skier until the tow rope is substantially taut. The boat is then accelerated quickly to cause the skier to rise to the surface of the water and be pulled at the same speed at which the boat is traveling.

The most common method for towing a water skier is securing the ski rope to the rear or stern of the boat. The simplest attachment for the rope is to a bow eye or ring mounted on the rear or stern of the boat, generally used for moving purposes, such as removing the boat from the water by a hoist. Such attachment points are generally near water line, and become even lower when the boat accelerates on start-up because the bow of the boat rises significantly out of the water. This initial downward force on the rope makes it difficult for the skier to rise out of the water. Moreover, when the skier moves from one side of the boat to the other, the rope often hits the wake of the boat. Desirably, the attachment point of the tow rope should have a vertical offset so that the rope is clear of the motor or other stern structures, and is maintained in proper attitude for pulling the skier (i.e., the taut rope is approximately parallel to the longitudinal axis of the boat.)

Various other prior art tow devices have been described. In one apparatus, an upstanding rope deploying means, having a hook on the top end, is mounted on the stern of the boat. The rope is attached to the mounting by looping it over the hook. See, e.g., Sell, U.S. Pat. No. 3,890,918, issued June 24, 1975; Moore, U.S. Pat. No. 3,122,609, issued Feb. 25, 1964.

The tow rope may also be secured to the boat by being wound around a winch and the rope fed through an eye affixed to a davit or davit-like structure which has sufficient vertical offset to clear the motor. The winching assembly can rewind the tow rope when the skier falls or otherwise releases the tow rope. See, e.g., Correll, U.S. Pat. No. 2,821,726, issued Feb. 4, 1958; Cox, U.S. Pat. No. 3,919,963, issued Nov. 18, 1975; Zetah, U.S. Pat. No. 4,133,496, issued Jan. 9, 1979.

In the case of a boat with an outboard motor, the tow rope may be mounted on the top of the motor. See, Cooke, U.S. Pat. No. 3,079,885, issued March 5, 1963. In yet another prior art apparatus, the tow rope is secured to a mounting secured to the floor of the boat with sufficient vertical offset to clear the motor. See, Paxton, U.S. Pat. No. 4,561,375, issued Dec. 31, 1985.

When a waterskier falls or otherwise releases the tow rope, the boat is decelerated so that the tow rope can be recovered or repositioned for the skier. Often, however, the trailing tow rope constitutes a navigational hazard for nearby boats. Other boats may pass even between the boat and the end of the rope, cutting off the rope. Frequently, when manually pulling in the rope, it becomes entangled in the propeller or propeller shaft of the motor and must be freed. Moreover, when more than one skier are being pulled by the boat and their ropes are released, it becomes very difficult for the boat operator to return to the skiers without the tow ropes becoming entangled and to position all the trailing tow ropes so that they may be retrieved by the skiers. Furthermore, when not in use, the rope often lies on the floor of the boat and frequently becomes tangled with passengers' feet or other items on the floor. Storage of more than one tow rope in the boat without entanglement is difficult.

Despite recognition of problems with tow rope attachment, rewind and storage, none of the foregoing apparatuses provides all the features of an attachment system with the sufficient offset to clear stern structures, convenient storage when not in use, and quick rewind capability. The present invention provides a tow rope apparatus with attachment point for the proper attitude to pull a skier and clear any obstructing structures, e.g., a motor, automatic rewind capability, and convenient storage of the rope.

SUMMARY OF THE INVENTION

The present invention relates to a tow apparatus for a boat which employs an axial deploying system for tow ropes, allows the tow ropes to be in proper attitude for pulling the skier, and provides means for allowing rapid rewind and convenient storage of the tow ropes. For the axial deploying system, the ends of one or more ropes proximate to the boat are passed interiorly through hollow channels of a ski tow bar which is conveniently secured to the boat, and are deployed from one end of the tow bar, clearing any obstructing structures. The positioning, generally upright or qenerally horizontally, and length of the tow bar depend upon the configuration of the boat, particularly the stern, e.g., whether the boat has an inboard or outboard motor. Supporting means is provided for supporting the tow bar in the boat. Securing means is provided for securing tow ropes to the boat. Preferably, the end of each tow rope proximate to the boat may be attached and wound on a reel that is mounted in the boat and driven by a motor under the control of the boat operator. The motor driven reel allows rapid rewinding of the rope and affords convenient storage of the rope. The system may also include means for preventing fraying of tow ropes.

In another aspect of the invention, when the ski tow bar is positioned generally upright, an abaxial rope-deploying system may be used in conjunction with the axial system. The abaxial, rope-deploying system includes two or more flanges extending from the top of tube which create an annular groove. A bight at the proximate end of a tow rope is accommodated in the groove.

A tow rope held and deployed by either system maintains the ski rope in proper attitude for the skier, i.e., above obstructing structures and approximately parallel to the longitudinal axis of the boat, and allows the skier enhanced mobility.

BRIEF DESCRIPTION OF THE DRAWING

The preferred exemplary embodiment of the present invention will hereinafter be described in conjunction with the appended drawing, wherein like designations denote like elements, and.

DETAILED DESCRIPTION

Figure 1:
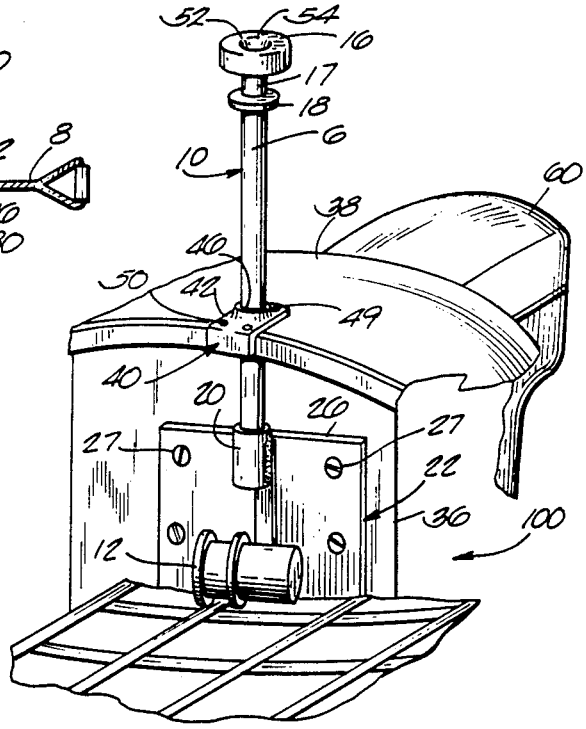
FIG. 1 is a perspective view of a tow apparatus according to one aspect of the present invention as installed in a boat.

As shown in FIG. 1, the tow apparatus 10, according to the present invention, is attached to a boat, generally designated as 100. The boat can be conventionally powered by either an inboard or an outboard motor. The positioning of tow apparatus 10 in any particular boat will depend upon the particular configuration and structure of the boat. According to the present invention, tow apparatus 10 may be positioned either in a generally upright or generally horizontal relationship to the bottom of the boat so that a tow rope 8, shown in FIGS. 2 and 3, for a skier connected to the tow apparatus 10 may be elevated sufficiently to clear any obstructing structures, e.g., a motor 60 of an outboard boat.

The tow apparatus 10 includes a ski tow bar 6 having an interior longitudinal channel 9. Tow bar 6 may be conveniently constructed of a material such as steel or chrome. The term "ski tow bar" or "tow bar" is meant to describe a generally cylindrical, hollow member, a tube or a pipe through which and from which tow ropes are deployed. The term "channel," when used in connection with the axial interior of tow bar 6, is meant to describe a tubular enclosed path, partition, passage, or course through which a tow rope passes.

According to one aspect of the present invention, as shown in FIG. 1, ski tow bar 6 may be secured in a generally upright or vertical position through a stern deck 38 of the boat. Tow bar 6 may extend above stern deck 38, with sufficient vertical offset so that its top end is positioned above any stern structures. Alternatively, tow bar 6 may be attached to a stern wall 36 and extend generally upright above the top of the stern wall. According to another aspect of the present invention, shown in FIG. 2, tow bar 6 may be secured in a generally horizontal position through the stern wall. The actual position of ski tow bar 6 will depend on the particular configuration of the boat. The length of tow bar 6 may vary depending on its positioning and on various structures, e.g., motor, which may be present. The diameter of tow bar 6 may also vary depending on the number of lengthwise channels therethrough, as is explained below.

Figure 3:
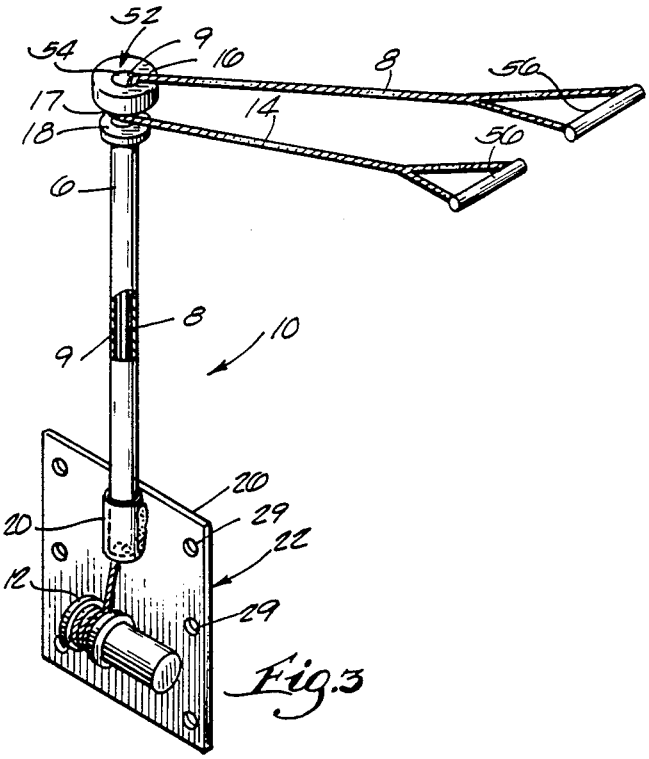
FIG. 3 is a perspective view of the engagement of the tow ropes according to one embodiment of the invention shown in FIG. 1.

Referring now to FIGS. 3, according to one aspect of the invention, the tow bar 6 may be suitably secured to the boat by means of a support assembly 22. The support assembly 22 includes a generally rectangular support plate 26, which may be affixed to the stern wall 36 or other convenient portion of the boat depending on its construction by fasteners, such as screws 27, which extend through a plurality of apertures 29 in the plate 26 so that the plate 26 is flush mounted with stern wall 36 or other convenient structure.

Means is provided on plate 26 for supporting the tow bar 6. Such means may be in the form of a receptacle 20 which is adapted to receive the bottom end 28 of tube 6. The receptacle 20 may be affixed by a suitable means such as welding to plate 26. The receptacle 20 is essentially a hollow cylinder with an inside diameter substantially the same as the outside diameter of tow bar 6. Receptacle 20 and support assembly 22 are suitably constructed of steel or chrome. The major axis of the receptacle 20 is generally perpendicular to the bottom of the boat.

Figure 4:
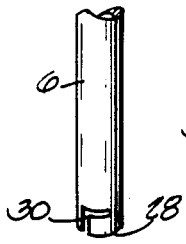
FIG. 4 is a perspective view of the bottom portion of the tow bar according to the invention.
Figure 5:
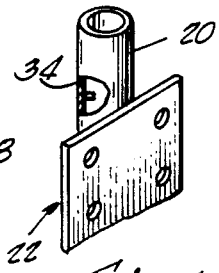
FIG. 5 is a perspective view of a portion of the support assembly for the tow bar according to the invention.

Referring now to FIGS. 4 and 5, means is provided in receptacle 20 for interlocking the tow bar 6 to the receptacle 20. Such means may be in the form of a pin 34 which is positioned to engage an L-shaped locking groove 30 provided in the bottom end 28 of the tow bar 6. When the bottom end 28 of the tow bar 6 is inserted into the receptacle 20, the vertical portion of the L-shaped groove 30 is aligned with the pin 34 in receptacle 20. The tow bar 6 is moved axially to align the pin 34 with the horizontal portion of the groove 30. The tow bar 6 is then rotated in receptacle 20 to lock the pin 34 in the groove 30 to prevent the tow bar 6 from jumping out of the receptacle 20.

Supporting means for tow bar 6 may optionally include a mounting plate 40 in the form of a flat member 42, as shown in FIG. 1. An aperture 46 is provided in member 42 and has a diameter sufficient to accommodate tow bar 6. The mounting plate 40 is affixed to stern deck 38 or stern wall 36, with the aperture 46 axially aligned with an aperture of the same diameter in stern deck 38 or stern wall 36. In addition, the plate 40 includes a plurality of apertures 49 through which fasteners 50, such as screws, are inserted for securing plate 40 flush with the stern deck 38 or stern wall 36.

In the embodiment of the present invention shown in FIGS. 1 and 3, means is provided at the upper end of tow bar 6 for guiding the tow rope 8 into the channel 9 in tow bar 6. Such means may be in the form of an upper flange or ring 16 which extends radially outwardly from the upper end of tow bar 6. The flange 16 includes a central opening 52 having a diameter corresponding to the inside diameter of tow bar 6. Means is provided in the opening 52 for preventing fraying of the tow rope. Such means may be in the form of a smooth outwardly curved surface 54 at the upper end of opening 52.

Figure 6:
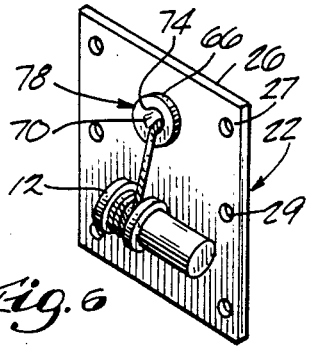
FIG. 6 is a perspective view of the aspect of the tow apparatus shown in FIG. 2.
Figure 2:
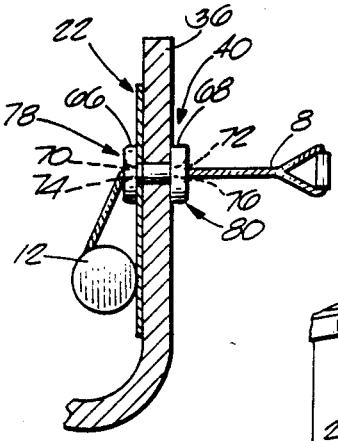
FIG. 2 is a sectional view of a tow apparatus according to another aspect of the present invention as installed in a boat.
Figures 7, 8:
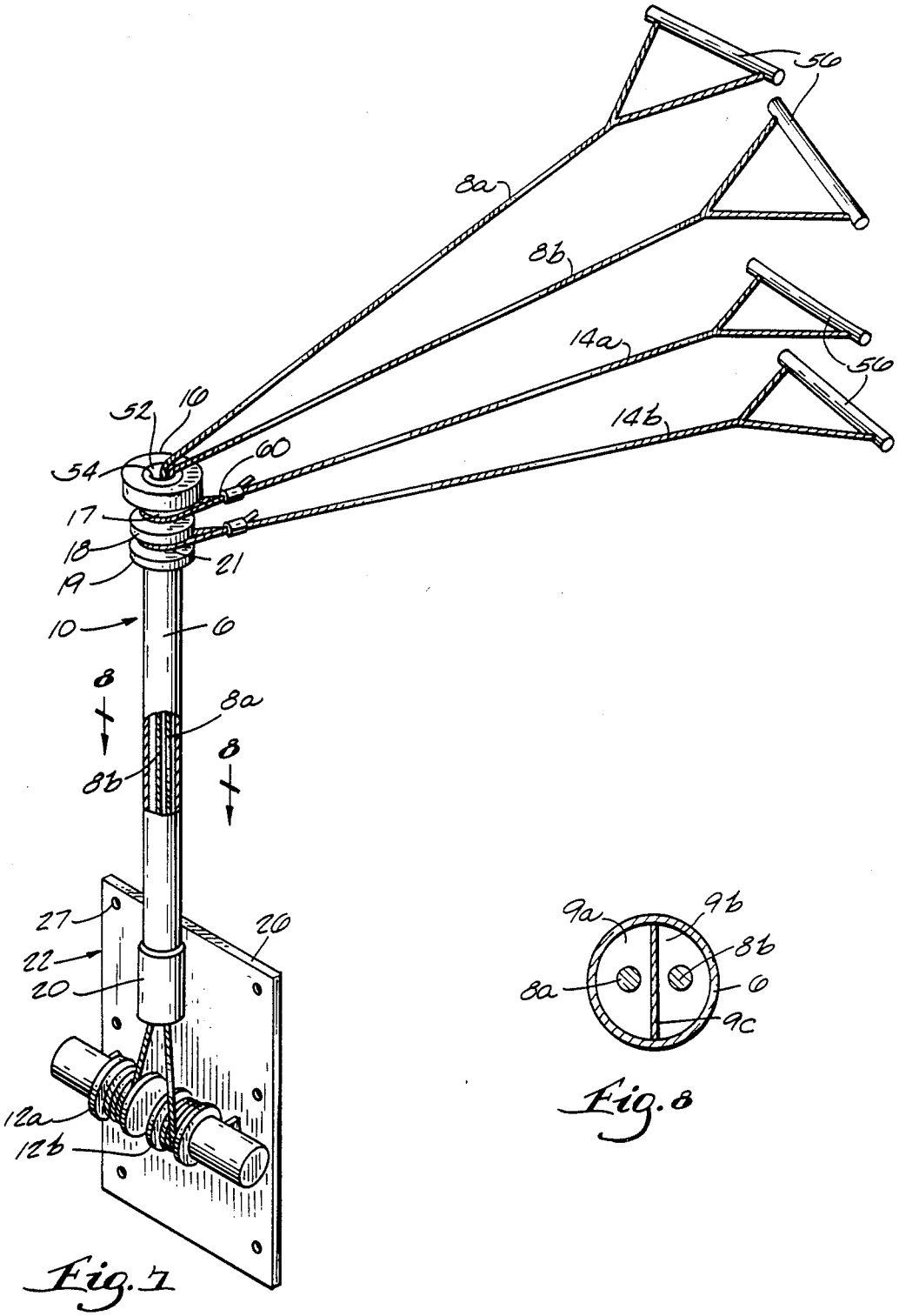
FIG. 7 is a perspective view of the engagement of multiple tow ropes according to one embodiment of the invention shown in FIG. 1.
FIG. 8 is a cross section taken along line 8—8 of FIG. 7, representing the interior of the tow bar according to one embodiment of the invention shown in FIG. 1.

Referring to FIGS. 2 and 6, in another embodiment of the invention for use in an inboard or outboard boat, tow bar 6 may be mounted generally horizontally through the stern wall 36 as shown in FIGS. 6 and 7. In this case, both ends of tow bar 6 include a flange or ring. Flange 66, positioned on the inside of the boat, extends radially outwardly from the inner end 78 of tow bar 6 and flange 68, positioned on the outside of the boat, extends radially outwardly from the outer end 80 of tow bar 6. Each flange includes a central opening 70 and 72, respectively, having a diameter corresponding to the inside diameter of tow bar 6. Means is provided in both openings 70 and 72 for preventing fraying of the tow rope. Such means may be in the form of a smooth outwardly curving surface 74 and 76 at opening 70 and 72 respectively. In this embodiment, no particular extra support structure of tow bar 6 is required as flanges 66 and 68 hold tow bar 6 fast in the stern wall.

Means is provided for securing the proximate end of rope 8 to the boat and for automatically extending and returning the tow rope. Preferably such means may be in the form of a reel 12 mounted on support plate 26. The proximate end of the tow rope 8 is suitably secured to reel 12. When reel 12 is rotated, tow rope 8 will either be extended or rewound depending on the direction of rotation. A distal end of tow rope 8, which typically includes handle 56, is engaged by the water skier.

To rewind tow rope 8, reel 12 is operated by any convenient source, such as a motor (not shown) which is under the control of the boat operator.

If tow bar 6 is positioned generally upright or vertically in the boat, tow rope 8 emerges from the top of channel 9 of tow bar 6. The upright offset of tow bar 6 is such that tow rope 8 is held above any obstructing structures, such as an outboard motor. Moreover, when the distal end of tow rope 8 is engaged by a skier, it is in a proper attitude to the skier and enhances the skier's mobility. Alternately, if tow bar 6 is positioned generally horizontally in the stern wall, tow rope 8 emerges from the outer end of tow bar 6 and also has sufficient vertical displacement to allow rope 8 to clear stern structures and holds rope 8 in proper attitude for the skier.

The present invention contemplates towing more than one skier and consequently may deploy more than one tow rope. Referring to FIGS. 7 and 8, tow bar 6 may include a plurality of channels, each of which has a tow rope passing therethrough, thereby avoiding entanglement. Each tow rope **8*a* and 8*b* has its own channel 9*a* and 9*b*, respectively, through which each tow rope passes. Channels 9*a* and 9*b* may be formed in channel 9 by a separator 9*c*, as seen in FIG. 8. Each tow rope 8*a* and 8*b* has its own reel, 12*a* and 12*b***, respectively, and motor capacity (not shown). In this aspect of the invention, the control box located adjacent to the boat operator may have a plurality of switches to wind the rope.

In the operation of the apparatus, the boat is maneuvered to a position adjacent to the skier so that the skier can take hold of the handle at the distal end of the tow rope. The operator of the boat then moves the boat forward slowly while the tow rope unwinds from the reel. When the tow rope has been unwound, the operator of the boat accelerates the motor and the boat accelerates quickly, causing the skier to rise to the surface of the water and be pulled.

During the skiing activity, the tow rope is held by the skier in a position essentially parallel to the longitudinal axis of the boat and to the surface of the water. The vertical offset of the tow bar 6 maintains the rope clear of the motor or other structures in the stern of the boat.

When the skier falls or otherwise releases the handle of the tow rope, the operator of the boat energizes the switch to operate the motor and to cause the reel to rotate in a direction to wind the tow rope onto the reel. Simultaneously, the operator of the boat circles back to the skier so that the skier can either climb into the boat or can again take hold of the handle after which the tow rope is played out and the skier continues skiing.

When the tow bar 6 is positioned generally upright in the boat, as shown in FIGS. 1 and 3, the accommodating of more than one skier and tow rope may also be accomplished by an abaxial deploying system according to the present invention. The term "abaxial" is meant to describe the mounting of a tow rope essentially perpendicular to tow bar 6. According to this aspect of the invention, a flange ring 18 is positioned in spaced relation below the first flange or ring 16 to create a groove 17 between the upper flange and the second flange. The term "groove" is meant to describe an annular notch, depression or channel. The end of rope 14 can then be secured to the tube 6 in the groove 17.

In this embodiment, the proximate end 59 of rope 14 is looped around the tow bar 6 and held in the groove 17 between the flange 16 and flange 18, as shown in FIG. 3. Rope 14 in this embodiment typically does not have a rewind capability. This embodiment of the invention allows rope 14 to clear the motor and maintain it in proper attitude for pulling the skier. Referring to FIGS. 7 and 8, tow bar 6 may have a plurality of flanges to form a plurality of grooves to accommodate several tow ropes. Flanges 16 and 18 create groove 17; flanges 18 and 19 create groove 21. Tow rope **14*a* may be looped around tow bar 6 and held in groove 17 between 16 and 18, while tow rope 14*b* may be looped around the tow bar and held in the groove 21 between 18 and 19**.

Modifications of the present invention, for example, in the positioning and support of the tow bar and number of skiers and ropes to be accommodated, may be suggested to or made by those of ordinary skill in the art without departing from the scope of the invention as expressed in the appended claims.

I claim:

1. An apparatus for holding and deploying tow ropes from a boat, comprising:

a tow bar having at least one channel therethrough for axially receiving a tow rope interiorly thereof;

a first flange mounted on one end of said tow bar, said flange having a curved surface forming an entrance to said channel in said tow bar;

a second flange mounted on said tow bar in a spaced relation to said first flange mounted on one end of said tow bar to form a first groove for an abaxially mounted tow rope;

supporting means for supporting said tow bar in the boat; and securing means mounted on said supporting means for securing the tow rope to the boat.

2. The apparatus of claim 1 wherein said securing means comprises a reel rotatably mounted on said supporting means, means for driving said reel, and means for controlling said driving means, and said supporting means comprises a support plate affixed to a stern wall of the boat and a receptacle affixed to said support plate into which the bottom end of said tow bar is secured.

3. The apparatus of claim 1 wherein said supporting means includes a mounting plate affixed to the boat for supporting the tow bar in a vertical relation and having a centrally disposed aperture of sufficient diameter to receive said tow bar.

4. The apparatus of claim 1, wherein said tow bar has two channels.

5. The apparatus of claim 1, further comprising a third flange mounted on said tow bar in a spaced relation to said second flange to form a second groove for an abaxially mounted tow rope.

6. The apparatus of claim 1, wherein a looped end of said abaxially mounted tow rope is positioned around said tow bar and held in said groove.

7. A method of towing a water skier from a boat, comprising the steps of:

mounting a tow bar having a channel therethrough for receiving interiorly thereof a first tow rope on the boat above obstructing structures and having flanges which create grooves therebetween;

deploying axially said first tow rope through said tow bar;

attaching a proximate end of said axially deployed tow rope to securing means on the boat;

securing a proximate end of a second tow rope abaxially to said tow bar in said grooves between said flanges in said tow bar;

engaging distal ends of said tow ropes in the hands of the water skiers; and accelerating the boat to cause the skiers to rise to the surface of the water and to travel at the same speed as the boat.

* * * * *